US005265300A

United States Patent [19]

O'Hara et al.

[11] Patent Number: 5,265,300

[45] Date of Patent: Nov. 30, 1993

[54] FLOOR SCRUBBER

[75] Inventors: Robert J. O'Hara, Southern Pines; Christopher M. Knowlton, Pinehurst, both of N.C.

[73] Assignee: AAR Corp., Elk Grove Village, Ill.

[21] Appl. No.: 819,790

[22] Filed: Jan. 13, 1992

[51] Int. Cl.[5] ..... A47L 11/16; A47L 11/283

[52] U.S. Cl. ..... 15/49.1; 15/50.1; 15/98; 15/320; 15/340.4

[58] Field of Search ..... 15/49.1, 50.1, 50.3, 15/52.1, 51, 52, 87, 98, 320, 340.3, 340.4; 51/177

[56] References Cited

U.S. PATENT DOCUMENTS

| | | | |
|---|---|---|---|
| 3,277,511 | 10/1966 | Little et al. | 15/320 |
| 3,345,671 | 10/1967 | Wilson et al. | 15/320 |
| 3,701,177 | 10/1972 | Meyer et al. | 15/50.1 |
| 3,866,541 | 2/1975 | O'Connor et al. | 15/50.1 |
| 3,942,218 | 3/1976 | Krier et al. | 15/50.1 |
| 3,996,636 | 12/1976 | Ashton | 15/50.1 |
| 4,006,506 | 2/1977 | Burgoon | 15/50.1 |
| 4,009,500 | 3/1977 | Ashton | 15/50.1 |
| 4,041,567 | 8/1977 | Burgoon | 15/320 |
| 4,364,138 | 12/1982 | Waldhauser et al. | 15/50.1 |
| 4,369,540 | 1/1983 | Burgoon et al. | 15/49.1 |
| 4,429,433 | 2/1984 | Burgoon | 15/50.1 |
| 4,490,873 | 1/1985 | Stratton | 15/49.1 |
| 4,506,405 | 3/1985 | Block | 15/320 |
| 4,619,010 | 10/1986 | Burgoon | 15/50.1 |
| 4,633,541 | 1/1987 | Block | 15/49.1 |
| 4,674,142 | 6/1987 | Meili | 15/49.1 |
| 4,942,638 | 7/1990 | Helm | 15/50.1 |
| 5,016,310 | 5/1991 | Geyer et al. | 15/49.1 |

*Primary Examiner*—Edward L. Roberts

*Attorney, Agent, or Firm*—Harness, Dickey & Pierce

[57] ABSTRACT

A floor scrubbing vehicle having scrub brushes mounted at the rear of the vehicle by a mechanism which allows both the brushes and squeegee to extend and retract transversely with respect to the vehicle. The mechanism is resilient, and allows the scrub brushes and squeegee to automatically retract inward upon contact with an immovable obstacle, and also causes automatic extension of the brushes and squeegee following passage of the obstacle. The scrub brushes and squeegee are mounted in a scrubbing pod frame which can rotate about a vertical axis with respect to the vehicle to prevent damage, or to facilitate access for repair and maintenance.

28 Claims, 4 Drawing Sheets

FLOOR SCRUBBER

BACKGROUND AND SUMMARY OF THE INVENTION

This invention relates generally to floor scrubbing vehicles, and more particularly to a unique mechanism for mounting the scrubbing apparatus.

Floor sweeping and scrubbing machines generally include more than one scrub brush and a laterally extending flexible squeegee. The scrub brushes and their respective rotational drive motors are typically mounted in a housing, or scrub head. This scrub head is variously located at the front, middle, or rear of the scrubbing machine. The scrub head is generally attached to the frame of the machine through a vertical motion mechanism so that the brushes may be raised from contact with the floor for inactive transportation and lowered into contact with the floor for active sweeping and scrubbing. Each scrub brush is mounted so as to remain in contact with the floor when scrubbing even though the floor may be uneven. The scrub head and squeegee normally do not extend beyond the horizontal limits of the machine frame, because they would be vulnerable to damage by collision with permanent objects. However, because the machine frame normally extends laterally further than the scrub head, the scrub brushes cannot scrub in close proximity to a wall. One solution for this problem is to provide a scrubbing side brush at a front corner of the machine extending out forwardly and laterally beyond the machine frame to scrub along walls. Unfortunately, the scrubbing pattern on the floor for a side brush often fails to match the pattern of the main brushes. Furthermore, a side brush may track outside of the pickup squeegee on turns due to its forward outwardly disposed location, and the side brush consequently leaves a trail of water and cleaning solution on the floor.

The present invention overcomes these disadvantages by providing a floor scrubbing vehicle or machine having a unique mounting mechanism for the scrub brushes and squeegee which permits horizontal motion of the scrub brushes and squeegee together, and in addition a novel hinge arrangement which permits the scrub brushes and squeegee to swing out away from the vehicle about a generally vertical axis. The scrub brushes and their respective drive motors are mounted onto a scrub head. The squeegee is mounted so as to move horizontally in conjunction with the scrub head. The scrub head and squeegee are mounted to the frame through a mechanism which allows for selective lateral motion of the scrub head and squeegee. The operator may selectively position the scrub head and squeegee laterally in order to scrub along a wall. The mechanism is also spring biased outwardly so that if any component extending beyond the horizontal limits of the machine frame contacts a permanent object, the scrub head and squeegee is free to be pushed inwardly by the object to avoid damage, and subsequently to automatically extend laterally outwardly to resume contact with the wall following passage of the permanent object. In addition, the scrub head and squeegee are mounted to the scrubbing machine frame by a hinge which allows the scrub head and squeegee to rotate about a vertical axis and swing out away from the machine frame. The scrub head and squeegee can thus break away from the machine frame if the extended scrub head and squeegee collide with an immovable object. The hinge further allows the scrub brush and squeegee to intentionally be pivoted out from the machine frame for the purposes of repair or maintenance.

It is therefore an object of the present invention to provide a unique floor scrubbing vehicle having a mechanism allowing horizontal motion of the scrub brushes in conjunction with a squeegee.

It is a further object of the present invention to provide a novel resilient coupling between the machine frame and the scrub head and squeegee so that the scrub head and squeegee will automatically retract in the event of striking an immovable obstacle and automatically extend following passage of the obstacle.

It is a further object of the present invention to provide a novel hinge and release means so that the scrub head and squeegee may rotate about a vertical axis, to prevent damage from contact with an immovable object, as well as to facilitate repair and maintenance.

These and other advantages and features will become apparent from the following description and claims in conjunction with the accompanying drawings.

DETAILED DESCRIPTION OF THE PREFERRED EMBODIMENT

Figure 1:
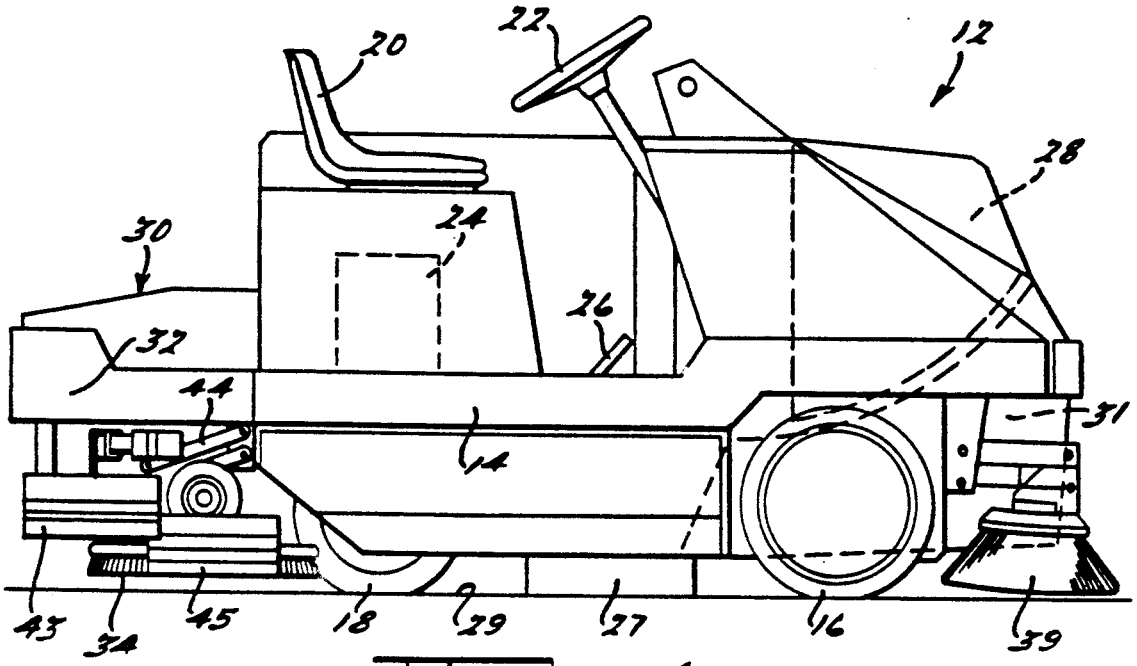
FIG. 1 is a side elevational view of a scrubbing vehicle embodying the principles of the present invention showing the scrub head and mounting mechanism in a raised non-operating position.
Figure 2:
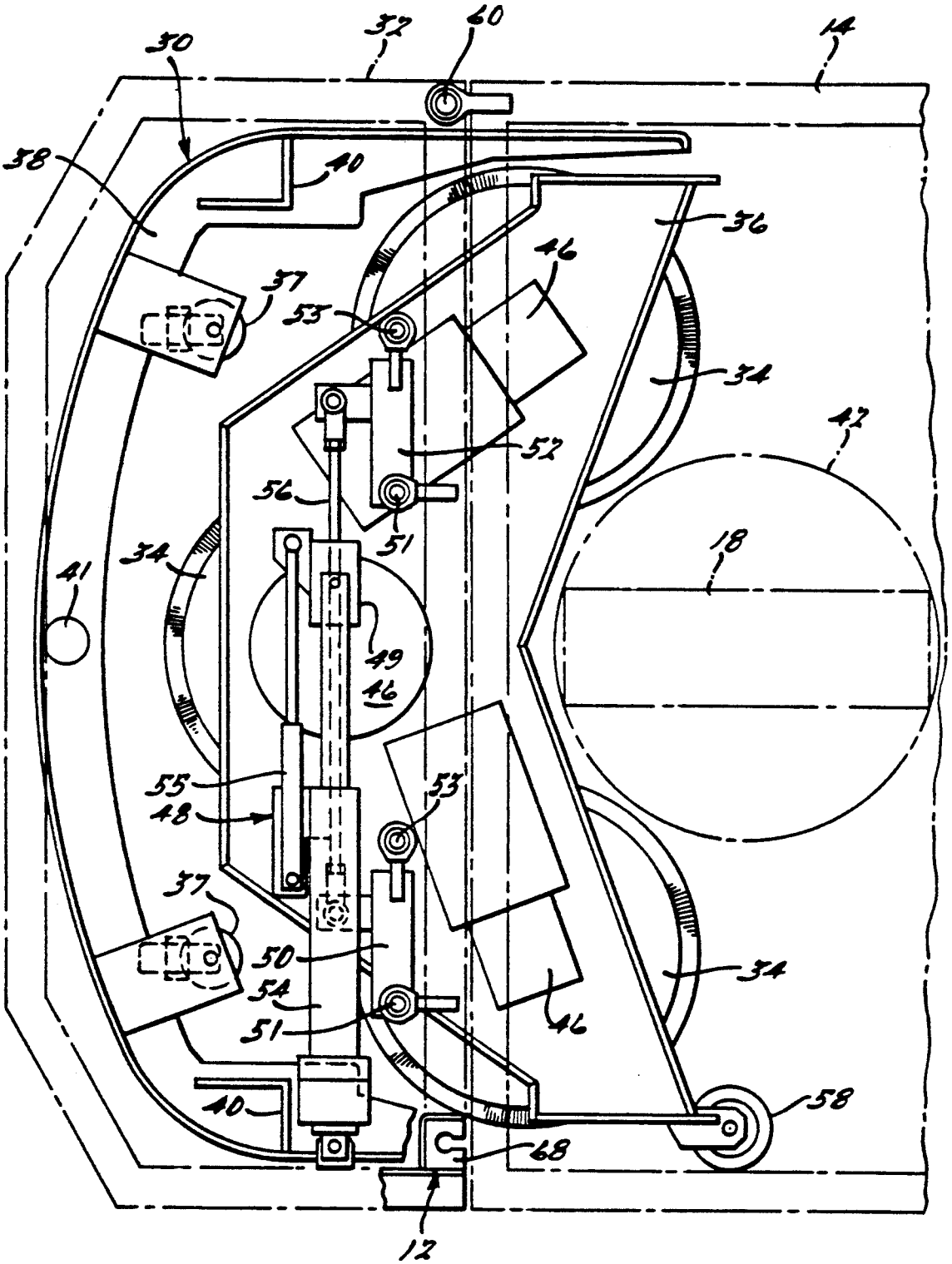
FIG. 2 is a diagrammatic top plan view showing the mounting mechanism of the present invention in its laterally retracted position.

With reference to the drawings, FIG. 1 shows a sweeping and scrubbing vehicle 12 having a frame 14 which supports the various machine components. The vehicle is carried on three wheels, including two wheels 16 located at the front of vehicle 12, and a single wheel 18 which can rotate about a generally vertical axis for steering located at the rear of the vehicle 12. The vehicle 12 includes an operator's seat 20, a steering wheel 22 for actuating rear wheel 18, a motor or engine 24, the usual control mechanism 26 for locomotion, a sweeper assembly 27 of conventional design resting on floor 29, a hopper 31 for storing the debris swept up by sweeper assembly 27, and tanks 28 for storing clean and dirty scrubbing solution. The scrubbing vehicle 12 is provided with a scrubbing pod 30 at the rear of the vehicle which consists of a scrubbing pod frame 32, three rotary scrub brushes 34 which are mounted on a scrub head 36, and a squeegee assembly 38. Squeegee assembly 38 is supported on floor 29 by castors 37, and is carried under pod frame 32 by support members 40. Squeegee 38 utilizes a vacuum hose 41 to pick up fluid from floor 29. Squeegee assembly 38 is preferably a single integral U-shaped member as shown in FIG. 2, or may be constructed of one main squeegee 43 with two side squeegees 45. The vehicle 12 may also include a forwardly and laterally outwardly disposed side broom 39.

As shown more clearly in FIG. 2, pod 30 preferably includes three rotary scrub brushes 34 which are driven by electric motors 46 and are mounted to scrub head 36 to rotate about generally vertical axes. The scrub brushes 34 may also be mounted to rotate about generally horizontal axes. The respective centers of the brushes describe an arc so that each scrub brush 34 is located proximate to, yet outside of the rear tire turning area 42. This configuration allows a more compact arrangement of the scrub brushes 34 about the rear wheel 18. The scrub head 36 is attached to pod 30 by a vertical motion mechanism 44 which allows it to be raised for transport and lowered for active scrubbing in the usual manner. When scrubbing, it will rise and fall to follow an uneven floor surface 29. As is customary, a downward force may be imparted upon the scrub head 36 to cause it to clean more effectively.

Figure 3:
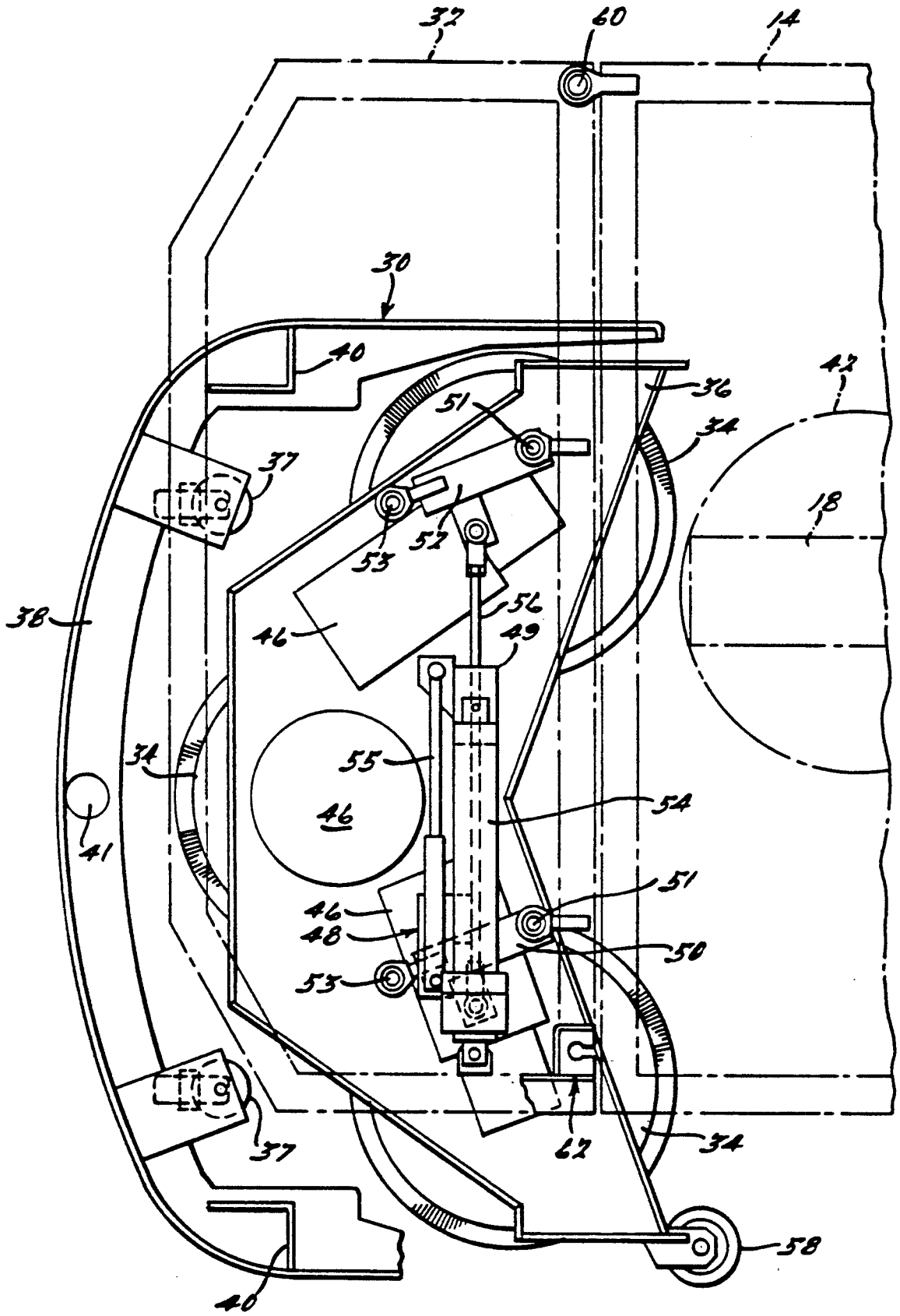
FIG. 3 is a view similar to FIG. 2 showing the mounting mechanism of the present invention in its laterally extended position.

As shown in FIGS. 2 and 3, scrub head 36 is mounted to the scrubbing pod frame 32 by a horizontal motion mechanism 48 that allows scrub brushes 34 and scrub head 36, in concert with squeegee assembly 38, to translate laterally. The scrub head 36 translates in an orbit without rotating about its own axis, such that each scrub brush 34 remains beyond the rear tire turning area 42. This orbital path allows a compact mounting arrangement, yet permits the scrub head 36 to shift laterally.

Figure 6:
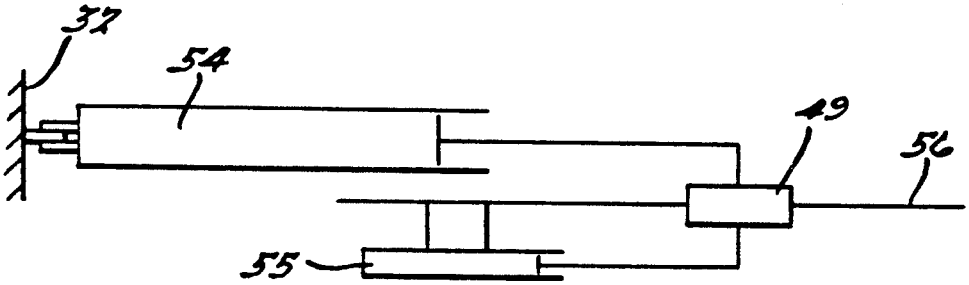
FIGS. 6 through 8 are diagrammatic front elevations showing the operation of the mounting mechanism.
Figure 7:
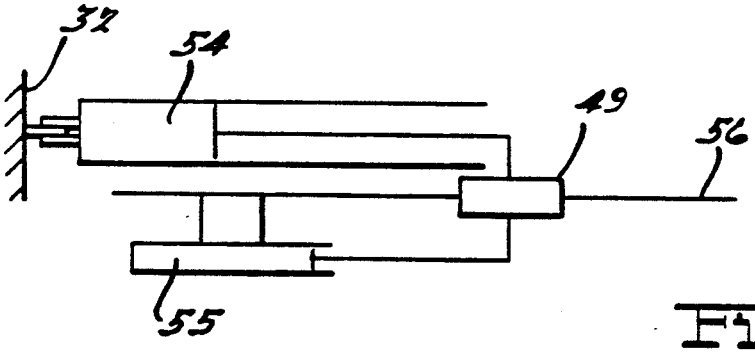
Figure 8:
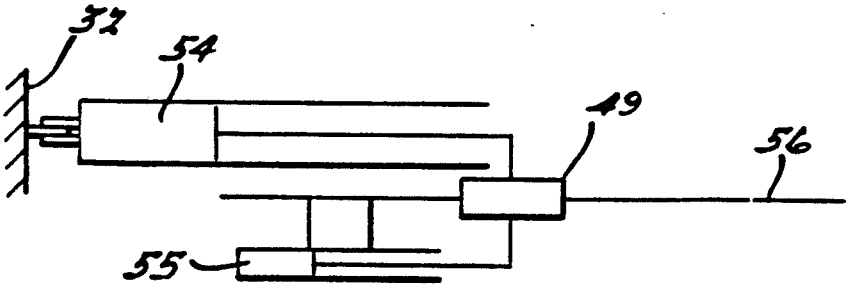

The mechanism 48 is shown in FIGS. 2, 3 and consists of the scrubbing pod frame 32, which is generally a reversed D-shape in plan, composing one ground link. Mechanism 48 includes first and second rocker arms 50 and 52 which are connected at one end to pod frame 32 by means of a pin and journal pivotal connector 51, and at the other end to scrub head 36 by a similar pivotal connector 53. Rocker arms 50 and 52 are mounted in a parallel configuration so that the scrubbing pod frame 32, the scrub head 36, and first and second parallel rocker arms 50 and 52 form a four bar mechanism. The operation of mechanism 48 is shown more clearly in FIGS. 6, 7 and 8, which depict a variable length member 54, preferably an electric actuator, which connects scrubbing pod frame 32 to a slider block 49 which is formed to slide freely on a traveller bar 56 which extends between similar points located near the outer ends of first and second rocker arms 50 and 52, and slider block 49 is affixed to the plunger of a gas spring 55. The base end of gas spring 55 is connected to traveller bar 56. To shift scrub head 36 laterally outward to an extended position of mechanism 48 as shown in FIG. 7, actuator 54 compresses and shortens in length, moving slider block 49 laterally. The gas spring 55 resists compression and exerts a force on traveller bar 56 to extend scrub head 36 laterally. A contact wheel 58 is affixed to scrub head 36 and extends outward beyond scrub head 36 and squeegee 38. When scrub head 36 is in an extended position and contact wheel 58 collides with and is urged inwards by an obstacle, scrub head 36 and traveller bar 56 are urged inwards to an extended position of mechanism 48 as shown in FIG. 8. Spring 55 is forced to compress because actuator 54 will not move, preventing slider block 49 from moving relative to pod frame 32. Thus, gas spring 55 compresses, and traveller bar 56 slides through slider block 49, and scrub head 36 retracts inward until the obstacle has passed, when gas spring 55 pushes scrub head 36 back out.

Actuator 54 is thus attached to spring member 55 which provides resilient resistance to horizontal motion of scrub head 36 and squeegee 38 to prevent damage to the elements. The mechanism 48 allows scrub head 36, scrub brushes 34, main squeegee 38, and side squeegees 40 to translate in an arc without rotating, which prevents any one of the scrub brushes 34 from entering the locus of possible positions enclosed by the rear tire turning area 42.

Mechanism 48 is shown in FIG. 3 in a laterally extended position. The operator may selectively actuate electric actuator 54 so as to place scrub head 36 and squeegees 38 into a selected lateral position, and mechanism 48 will provide for automatic retraction in the event that the wall contact wheel 58 encounters an obstruction. Mechanism 48 further automatically extends scrub brushes 34, scrub head 36 and squeegees 38 laterally outward after passage of the obstruction.

Figure 4:
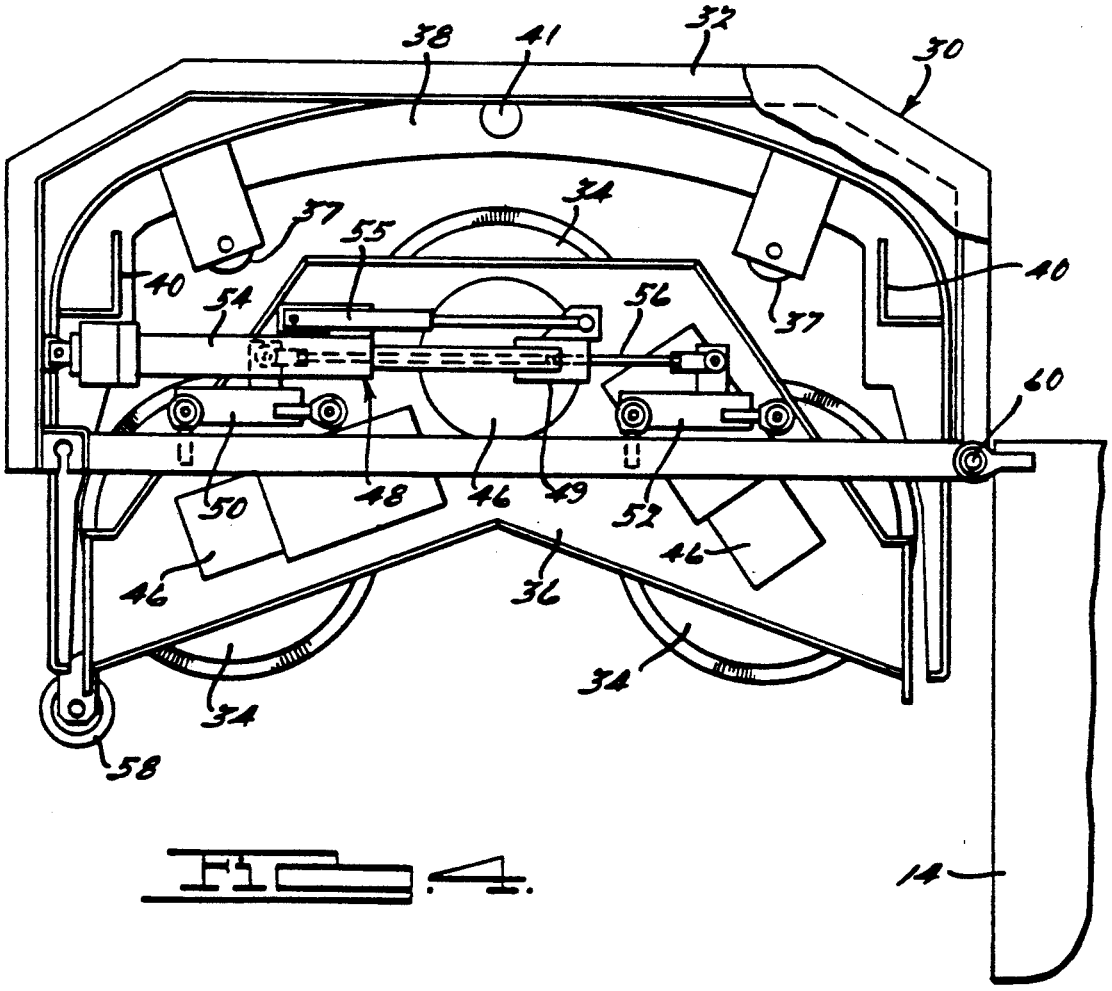
FIG. 4 is a view similar to FIG. 2 showing the mounting mechanism of the present invention in a position in which it has been swung away from the vehicle.

As shown in FIG. 4, horizontal motion mechanism 48, and thus scrub head 36 and squeegee 38, is mounted to a scrubbing pod frame 32, which is mounted to vehicle frame 14 by a hinge 60, which allows scrubbing pod 30 to be rotated around a generally vertical axis. In the preferred embodiment, the scrubbing pod may rotate at least up to 90 degrees. FIG. 4 shows scrubbing pod 30 in a rotated position. Hinge 60 allows for rotation of scrubbing pod 30 in the event of collision with an immovable object, or for access to scrub head 36, scrub brushes 34, drive motors 46, and squeegee 38 for the purposes of maintenance or repair.

Figure 5:
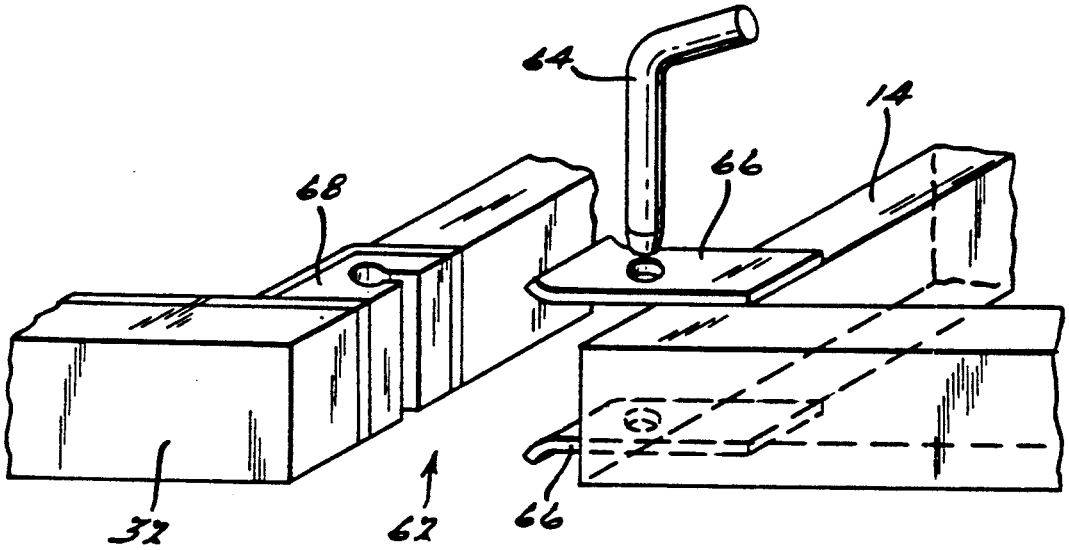
FIG. 5 is a partial perspective view of the retainer and release mechanism according to the present invention.

A release retainer 62 is shown in FIGS. 2 and 5, which releasably clamps scrubbing pod frame 32 in place adjacent to vehicle frame 14. Retainer 62 consists of a pin 64 passed through perforated plates 66 which are affixed to vehicle frame 14 and a flexible retainer clamp 68 formed to accept pin 64 in an interlocking relationship. Retainer clamp 68 is preferably formed of a block of rubber. If scrub head 36, squeegee 38 and contact wheel 58 are extended laterally outward and encounter an immovable obstacle such that resilient shifting inward of the scrub head 36 is insufficient, pin 64 will separate from rubber retainer clamp 68, allowing scrubbing pod 30 to rotate rearwardly to prevent damage to squeegee 38, scrub brushes 34 or scrub head 36. Scrubbing pod 30 may also be swung out for maintenance and repair by removing pin 64 from retainer 62.

It should be understood that the preferred embodiment of the invention has been shown and described herein, and that various modifications of the preferred embodiment will become apparent to those skilled in the art after a study of the specification, drawings, and the following claims.

What is claimed is:

1. A scrubbing vehicle for moving in a longitudinal direction and cleaning a surface, comprising:

a) at least one scrub brush adapted to rotate about a generally vertical axis;

b) at least one squeegee for picking up a fluid from said surface; and c) a horizontal motion mechanism for mounting said scrub brush and said squeegee to said vehicle for concurrent transverse extension and retraction with respect to said vehicle, said squeegee remaining in substantially constant angular orientation with respect to said vehicle during said extension and retraction.

2. The vehicle as set forth in claim 1, wherein said horizontal motion mechanism is spring-loaded, allowing for resilient horizontal lateral extension and retraction of said scrub brush and said squeegee.

3. The vehicle as set forth in claim 2, wherein said horizontal motion mechanism further comprises a spring member, said spring member being operative to allow for resilient retraction of said scrub brush and said squeegee upon contact with an immovable object and providing for subsequent spring-loaded extension of said brush and said squeegee in conjunction, following contact with said object.

4. The vehicle as set forth in claim 1, wherein said horizontal motion mechanism further comprises a frame, a scrub head mounted to said frame, said scrub brush being mounted to said scrub head.

5. The vehicle as set forth in claim 4, wherein said horizontal motion mechanism further comprises at least two swing arms, said swing arms having first and second ends, said first ends rotatably mounted to said frame by first pivotal connectors operative to allow said swing arms to rotate relative to said frame about generally vertical axes, said second ends rotatably mounted to said scrub head by second pivotal connectors operative to allow said swing arms to rotate relative to said scrub head about generally vertical axes, such that said horizontal motion mechanism allows said scrub head to translate horizontally with respect to said frame in an arc, said scrub head remaining in constant angular orientation with respect to said frame throughout said horizontal translation.

6. The vehicle as set forth in claim 1, which further comprises a vehicle frame and a scrubbing pod frame, said scrub brush and said squeegee being mounted to said scrubbing pod frame, and a hinge for mounting said scrubbing pod frame to said vehicle frame such that said scrubbing pod frame may rotate relative to said vehicle frame about a generally vertical axis.

7. The vehicle as set forth in claim 6, which further comprises a retainer operative to releasably retain said scrubbing pod frame in position adjacent to said vehicle frame.

8. The vehicle as set forth in claim 1, which further comprises:

a) a plurality of scrub brushes;

b) a plurality of wheels, at least one of said wheels adapted to rotate about a generally vertical axis for steering said vehicle;

c) a turning area defined by said steering wheel as it moves through its steering positions;

d) said scrub brushes being mounted in close proximity to, yet outside of, said turning area; and e) said horizontal motion mechanism being adapted to transversely extend and retract said scrub brushes such that said brushes remain outside of said turning area throughout said extension and retraction.

9. A scrubbing vehicle for moving forwardly in a longitudinal direction and cleaning a surface, comprising:

a) a plurality of wheels for engaging said surface;

b) at least one scrub brush adapted to rotate around a generally vertical axis; and c) a horizontal motion mechanism located at the trailing end of said vehicle following said wheels for mounting said scrub brush to said vehicle for transverse extension and retraction with respect to said vehicle.

10. The vehicle as set forth in claim 9, wherein said horizontal motion mechanism is spring-loaded, allowing for resilient horizontal lateral extension and retraction of said scrub brush.

11. The vehicle as set forth in claim 10, wherein said horizontal motion mechanism further comprises a spring member, said spring member being operative to allow for resilient retraction of said scrub brush upon contact with an immovable object and providing for subsequent spring-loaded extension of said brush following contact with said object.

12. The vehicle as set forth in claim 9, which further comprises a frame, a scrub head mounted to said frame, said scrub brush being mounted to said scrub head.

13. The vehicle as set forth in claim 9, which further comprises a vehicle frame, a scrubbing pod frame, said scrub brush being mounted to said scrubbing pod frame, and a hinge for mounting said scrubbing pod frame to said vehicle frame such that said scrubbing pod frame may rotate relative to said vehicle frame about a generally vertical axis.

14. The vehicle as set forth in claim 13, which further comprises a retainer operative to releasably retain said scrubbing pod frame in position adjacent to said vehicle frame.

15. The vehicle as set forth in claim 9, which further comprises a squeegee for picking up a fluid from said surface.

16. The vehicle as set forth in claim 9, which further comprises:

a) a plurality of scrub brushes;

b) at least one of said plurality of wheels being adapted to rotate about a generally vertical axis for steering said vehicle;

c) a turning area defined by said steering wheel as it moves through its steering positions;

d) said scrub brushes being mounted in close proximity to, yet outside of, said turning area; and e) said horizontal motion mechanism being adapted to transversely extend and retract said scrub brushes such that said brushes remain outside of said turning area throughout said extension and retraction.

17. A scrubbing vehicle for moving forwardly in a longitudinal direction and cleaning a surface, comprising:

a) at least one scrub brush adapted to rotate around a generally vertical axis; and b) a horizontal motion mechanism located at the trailing end of said vehicle for mounting said scrub brush to said vehicle for transverse extension and retraction with respect to said vehicle, wherein said horizontal motion mechanism has at least two swing arms, said swing arms having first and second ends, said first ends rotatably mounted to said frame by first pivotal connectors operative to allow said swing arms to rotate relative to said frame about generally vertical axes, said second ends rotatably mounted to said scrub head by second pivotal connectors operative to allow said swing arms to rotate relative to said scrub head about generally vertical axes, such that said horizontal motion mechanism allows said scrub head to translate horizontally with respect to said frame in an arc, said scrub head remaining in constant angular orientation with respect to said frame throughout said horizontal translation.

18. A scrubbing vehicle for moving in a horizontal direction and cleaning a surface, comprising:

a) a vehicle frame having a front end and a rear end;

b) a plurality of wheels for engaging said surface;

c) a scrubbing pod frame located at said rear end of said vehicle frame behind said wheels, said scrubbing pod frame being mounted to said vehicle frame by a pivotal hinge adapted to allow said scrubbing pod frame to rotate relative to said vehicle frame about a generally vertical axis;

d) at least one scrub brush adapted to rotate around a generally vertical axis; and e) at least one squeegee for picking up a fluid from said surface, said scrub brush and said squeegee being mounted to said scrubbing pod frame.

19. The vehicle as set forth in claim 18, which further comprises a retainer operative to releasably retain said scrubbing pod frame in position adjacent to said vehicle frame.

20. The vehicle as set forth in claim 18, which further comprises a horizontal motion mechanism for concurrent transverse extension and retraction of said scrub brush and said squeegee with respect to said vehicle.

21. The vehicle as set forth in claim 20, which further comprises:

a) a plurality of scrub brushes;

b) at least one of said plurality of wheels being adapted to rotate about a generally vertical axis for steering said vehicle;

c) a turning area defined by said steering wheel as it moves through its steering positions;

d) said scrub brushes being mounted in close proximity to, yet outside of, said turning area; and e) said horizontal motion mechanism being adapted to transversely extend and retract said scrub brushes such that said brushes remain outside of said turning area throughout said extension and retraction.

22. The vehicle as set forth in claim 18, which further comprises a scrub head mounted to said scrubbing pod frame, said scrub brush being mounted to said scrub head.

23. A scrubbing vehicle for moving in a horizontal direction and cleaning a surface, comprising:

a) a vehicle frame having a front end and a rear end;

b) a scrubbing pod frame located at said rear end of said vehicle frame, said scrubbing pod frame being mounted to said vehicle frame by a pivotal hinge adapted to allow said scrubbing pod frame to rotate relative to said vehicle frame about a generally vertical axis;

c) at least one scrub brush adapted to rotate around a generally vertical axis; and d) at least one squeegee for picking up a fluid from said surface, said scrub brush and said squeegee being mounted to said scrubbing pod frame, wherein said horizontal motion mechanism is spring-loaded, allowing for resilient horizontal lateral extension and retraction of said scrub brush and said squeegee.

24. The vehicle as set forth in claim 23, wherein said spring-loaded horizontal motion mechanism comprises a spring member, said spring member being operative to allow for resilient retraction of said scrub brush and said squeegee upon contact with an immovable object and providing for subsequent spring-loaded extension of said brush and said squeegee in conjunction, following contact with said object.

25. A scrubbing vehicle for moving in a horizontal direction and cleaning a surface, comprising:

a) a vehicle frame having a front end and a rear end;

b) a scrubbing pod frame located at said rear end of said vehicle frame, said scrubbing pod frame being mounted to said vehicle frame by a pivotal hinge adapted to allow said scrubbing pod frame to rotate relative to said vehicle frame about a generally vertical axis;

c) at least one scrub brush adapted to rotate around a generally vertical axis;

d) at least one squeegee for picking up a fluid from said surface, said scrub brush and said squeegee being mounted to said scrubbing pod frame; and e) a horizontal motion mechanism for concurrent transverse extension and retraction of said scrub brush and said squeegee with respect to said vehicle, wherein said horizontal motion mechanism has at least two swing arms, said swing arms having first and second ends, said first ends rotatably mounted to said frame by first pivotal connectors operative to allow said swing arms to rotate relative to said frame about generally vertical axes, said second ends rotatably mounted to said scrub head by second pivotal connectors operative to allow said swing arms to rotate relative to said scrub head about generally vertical axes, such that said horizontal motion mechanism allows said scrub head to translate horizontally with respect to said frame in an arc, said scrub head remaining in constant angular orientation with respect to said frame throughout said horizontal translation.

26. A scrubbing vehicle for moving in a forward horizontal direction and cleaning a surface comprising:

a) a plurality of scrub brushes adapted to rotate about generally vertical axes;

b) a plurality of wheels, at least one of said wheels being a steering wheel adapted to rotate about a generally vertical axis for steering said vehicle;

c) a turning area defined by said steering wheel as it moves through its steering positions;

d) said scrub brushes being mounted rearward of said wheels and in close proximity to, yet outside of, said turning area, a portion of at least one scrub brush extending forward of a portion of said turning area in a retracted position; and e) a horizontal motion mechanism for mounting said scrub brushes to said vehicle for transverse extension and retraction of said scrub brushes.

27. The vehicle as set forth in claim 26, wherein said horizontal motion mechanism extends and retracts said scrub brushes such that said brushes remain outside of said turning area throughout said extension and retraction.

28. A scrubbing vehicle for moving in a horizontal direction and cleaning a surface, comprising:

a) at least one scrub brush;

b) a vehicle frame and a scrubbing pod frame;

c) a horizontal motion mechanism for mounting said scrub brush to said scrubbing pod frame for transverse extension and retraction with respect to said scrubbing pod frame, said horizontal motion mechanism being spring-loaded to allow for resilient retraction of said scrub brush upon contact with an immovable obstacle to prevent damage, and providing for subsequent spring-loaded extension of said brush following contact with said vehicle;

d) a hinge for mounting said scrubbing pod frame to said vehicle frame such that said scrubbing pod frame may rotate relative to said vehicle frame about a generally vertical axis;

e) a retainer operative to releasably retain said scrubbing pod frame in position adjacent to said vehicle frame, said retainer operative to release said scrubbing pod frame to rotate with respect to said vehicle frame upon contact with an immovable obstacle.

* * * * *